US011511390B2

(12) United States Patent
Zuniga et al.

(10) Patent No.: US 11,511,390 B2
(45) Date of Patent: Nov. 29, 2022

(54) PIVOTABLE SUBSTRATE RETAINING RING

(71) Applicant: Applied Materials, Inc., Santa Clara, CA (US)

(72) Inventors: Steven M. Zuniga, Soquel, CA (US); Jay Gurusamy, Santa Clara, CA (US); Andrew J. Nagengast, Sunnyvale, CA (US)

(73) Assignee: Applied Materials, Inc., Santa Clara, CA (US)

( * ) Notice: Subject to any disclaimer, the term of this patent is extended or adjusted under 35 U.S.C. 154(b) by 266 days.

(21) Appl. No.: 16/689,655

(22) Filed: Nov. 20, 2019

(65) Prior Publication Data

US 2021/0060726 A1 Mar. 4, 2021

Related U.S. Application Data

(60) Provisional application No. 62/894,662, filed on Aug. 30, 2019.

(51) Int. Cl.
*B24B 37/10* (2012.01)
*B24B 37/32* (2012.01)
*B24B 41/06* (2012.01)

(52) U.S. Cl.
CPC ..... *B24B 37/32* (2013.01); *B24B 37/10* (2013.01); *B24B 41/067* (2013.01)

(58) Field of Classification Search
CPC ..... B24B 37/10; B24B 37/30; B24B 37/32; B24B 41/067; B24B 41/06
USPC ..... 451/397, 398, 402
See application file for complete search history.

(56) References Cited

U.S. PATENT DOCUMENTS

| | | | | |
|---|---|---|---|---|
| 6,354,928 | B1 * | 3/2002 | Crevasse | B24B 37/32 451/41 |
| 6,436,228 | B1 | 8/2002 | Zuniga et al. | |
| 6,579,151 | B2 * | 6/2003 | Tseng | B24B 37/32 451/287 |
| 7,048,621 | B2 * | 5/2006 | Chen | B24B 37/005 451/398 |
| 8,070,560 | B2 * | 12/2011 | Yasuda | B24B 37/30 451/286 |
| 9,403,255 | B2 * | 8/2016 | Fukushima | B24B 49/16 |
| 2012/0034848 | A1 | 2/2012 | Chen et al. | |

* cited by examiner

*Primary Examiner* — Eileen P Morgan
(74) *Attorney, Agent, or Firm* — Fish & Richardson P.C.

(57) ABSTRACT

A carrier head includes a base assembly, a substrate mounting surface connected to the base assembly, and a plurality of segments disposed circumferentially around the substrate mounting surface to provide a retaining ring to surround a substrate mounted on the substrate mounting surface. An inner surface of each of the plurality of segments is configured to engage the substrate, and each segment of the plurality of segments of the retaining ring is pivotally connected to the base assembly such that a lower portion of each segment of the retaining ring is swingable toward and away from the substrate.

9 Claims, 6 Drawing Sheets

PIVOTABLE SUBSTRATE RETAINING RING

CROSS-REFERENCE TO RELATED APPLICATIONS

This application claims priority to U.S. Application Ser. No. 62/894,662, filed on Aug. 30, 2019, the disclosure of which is incorporated by reference.

TECHNICAL FIELD

This invention relates to a carrier head for use in chemical mechanical polishing (CMP).

BACKGROUND

Integrated circuits are typically formed on substrates, particularly silicon wafers, by the sequential deposition of conductive, semiconductive or insulative layers. After each layer is deposited, the layer is etched to create circuitry features. As a series of layers are sequentially deposited and etched, the outer or uppermost surface of the substrate, i.e., the exposed surface of the substrate, becomes increasingly non-planar. This non-planar surface presents problems in the photolithographic steps of the integrated circuit fabrication process. Therefore, there is a need to periodically planarize the substrate surface.

Chemical mechanical polishing (CMP) is one accepted method of planarization. This planarization method typically requires that the substrate be mounted on a carrier or polishing head. The exposed surface of the substrate is placed against a rotating polishing pad. The polishing pad may be a "standard" pad in which the polishing pad surface is a durable, roughened surface, or a fixed abrasive pad in which abrasive particles are held in a containment media. The carrier head provides a controllable load, i.e., pressure, on the substrate to push it against the polishing pad. A polishing slurry, including at least one chemically-reactive agent, and abrasive particles if a standard pad is used, is supplied to the polishing pad.

In the planarization of semiconductor substrate wafers by CMP, it is known to use an annular retaining ring encompassing a wafer being polished for the purpose of preventing lateral movement of the wafer resulting from friction between the wafer and a moving polishing pad.

A reoccurring problem in CMP is the so-called "edge-effect," i.e., the tendency for the edge of the substrate to be polished at a different rate than the center of the substrate. The edge effect typically results in damage to and over-polishing of (the removal of too much material from the substrate) the circumference portion of the substrate, e.g., the outermost five to ten millimeters, although the edge effect may also result in under-polishing. The over-polishing or under-polishing of the substrate circumference reduces the overall flatness of the substrate, makes the edge of the substrate unsuitable for use in integrated circuits.

SUMMARY

In one aspect, a carrier head includes a base assembly, a substrate mounting surface connected to the base assembly, and a plurality of segments disposed circumferentially around the substrate mounting surface to provide a retaining ring to surround a substrate mounted on the substrate mounting surface. An inner surface of each of the plurality of segments is configured to engage the substrate, and each segment of the plurality of segments of the retaining ring is pivotally connected to the base assembly such that a lower portion of each segment of the retaining ring is swingable toward and away from the substrate.

In another aspect, a carrier head includes a base assembly, a substrate mounting surface connected to the base assembly, a plurality of segments disposed circumferentially around the substrate mounting surface to provide a collet retaining ring to surround a substrate mounted on the substrate mounting surface, and an outer ring that is vertically movable relative to the plurality of segments. An inner surface of the collet retaining ring is configured to engage a substrate, and the collet retaining ring and outer ring are configured such that vertical motion of the outer ring controls motion of the collet retaining ring between a clamping and unclamping position.

Possible advantages may include, but are not limited to, one or more of the following. By tightly clamping the substrate with the retaining ring and thereby eliminating the gap between the substrate and the retaining ring, the edge-effect resulting from collisions between a substrate and a retaining ring during CMP can be reduced in comparison to a substrate contained loosely within the retaining ring. Damage to the edges of the substrate can be reduced, and damage to the inner surface of the retaining ring can be reduced. Resultant over-polishing and under-polishing due to the edge-effect can be reduced, and within-wafer uniformity can be improved. The lifetime of the retaining ring can be extended, resulting in lower cost operation.

DETAILED DESCRIPTION

In some polishing systems, a retaining ring is used to loosely retain a substrate during polishing. However, friction from the polishing pad tends to drive the substrate against the inner surface of the retaining ring. Collisions between the substrate and the retaining ring from this can lead to scoring, fracturing, or polishing non-uniformity, e.g., the "edge-effect", and can similarly cause wear and tear on the inner surface of the retaining ring. Eliminating the gap between the substrate and the retaining ring during polishing can reduce the edge-effect on the substrate and reduce the likelihood of damage to both the substrate and the retaining ring.

Figure 1A:
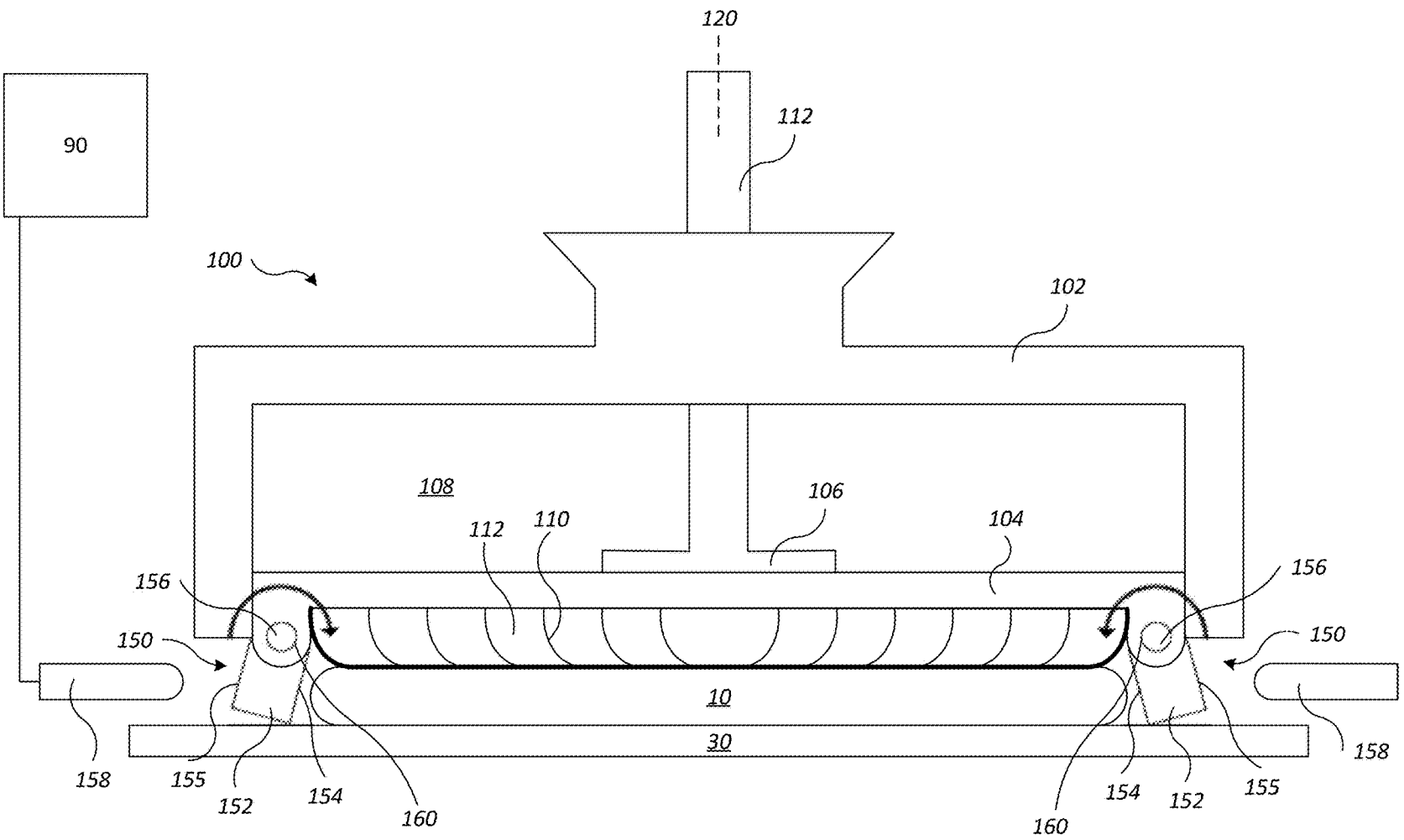
FIG. 1A is a schematic side view of a carrier head with a pivoting retaining ring.
Figure 1B:
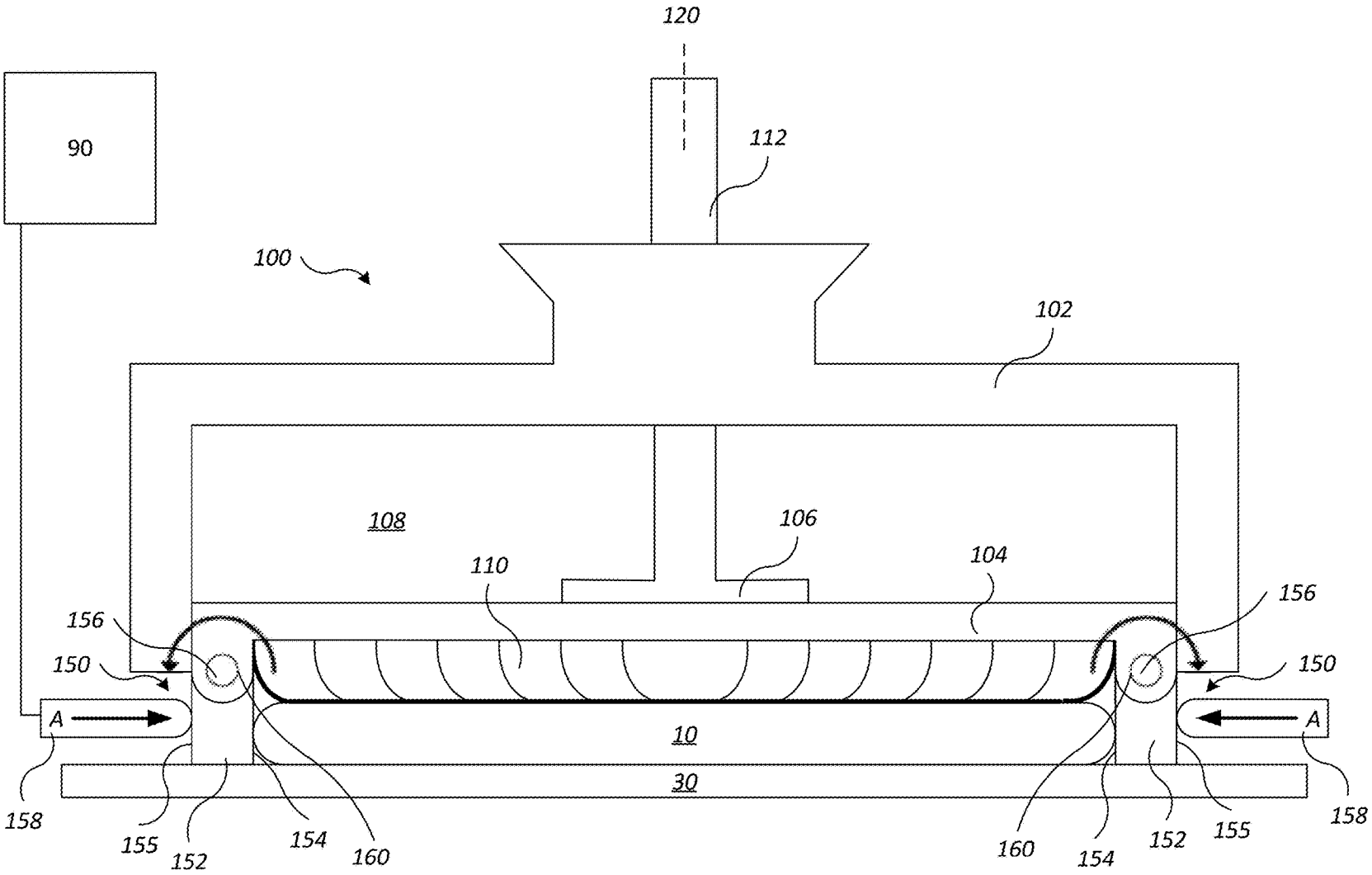
FIG. 1B is a schematic side view of the carrier head of FIG. 1A with the retaining ring pivoted to contact the edge of a substrate.
Figure 1D:
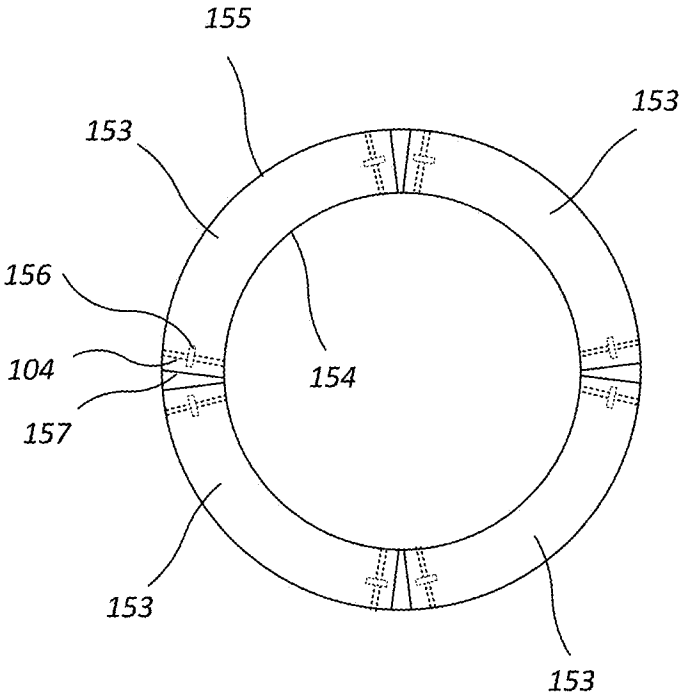
FIG. 1D is a schematic bottom view of the retaining ring.
Figure 1C:
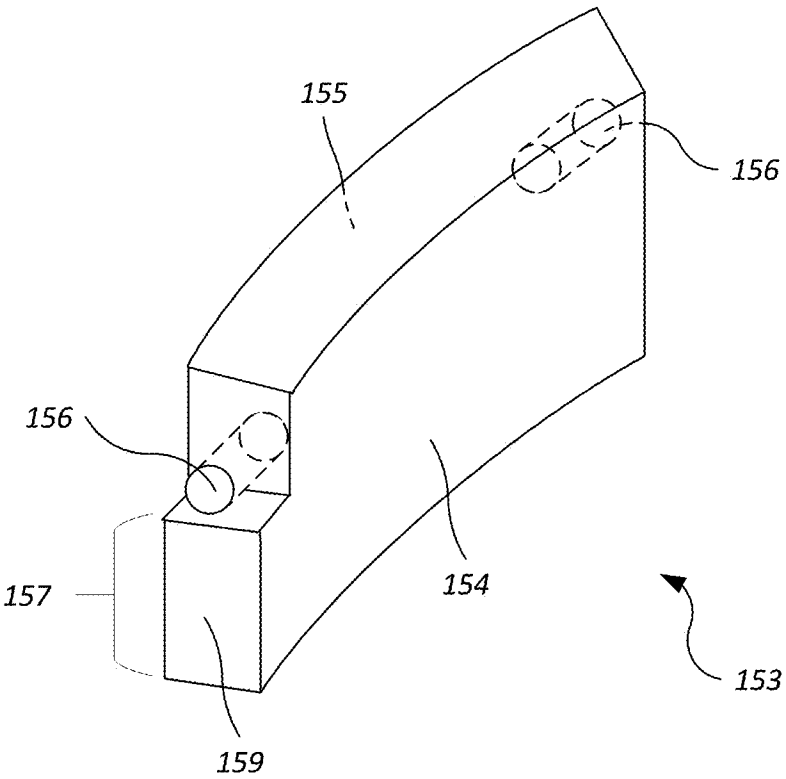
FIG. 1C is a schematic perspective view of a segment of the retaining ring.

Referring to FIGS. 1A and 1B, a substrate 10 will be polished by a chemical mechanical (CMP) apparatus that has a carrier head 100. The carrier head 100 includes a housing 102, a base assembly 104, a gimbal mechanism 106 (which may be considered part of the base assembly 104), a loading chamber 108, and a retaining ring assembly 150.

The housing 102 can generally be circular in shape and can be connected to a drive shaft 112 to rotate therewith during polishing around an axis 120. There may be passages (not illustrated) extending through the housing 102 for pneumatic control of the carrier head 100. The base assembly 104 is a vertically movable assembly located beneath the housing 102. The gimbal mechanism 106 permits the base assembly 104 to gimbal relative to the housing 102 while preventing lateral motion of the base assembly 104 relative to the housing 102. The loading chamber 108 is located between the housing 102 and the base assembly 104 to apply a load, i.e., a downward pressure or weight, to the base assembly 104. The vertical position of the base assembly 104 relative to a polishing pad is also controlled by the loading chamber 108. In some implementations, a single unitary body replaces the housing and the base assembly.

Connected to the base assembly 104 is a flexible membrane 110 that defines a pressurizable chamber configured to mount a substrate 10. A bottom surface of the membrane 110 can serve as a substrate mounting surface. The membrane 110 can also divide the volume below the base assembly 104 into a plurality of pressurizable chambers 112.

A retaining ring can be used to clamp the substrate 10 during a polishing operation. Referring to FIGS. 1A-1D, surrounding the substrate 10 is the retaining ring assembly 150. The retaining ring assembly 150 includes a plurality of segments 153, e.g., arcuate segments, that together provide a retaining ring 152. There can be two to twenty segments 153, e.g., fourteen segments, and the segments 153 of the retaining ring 152 are positioned to be disposed along the circumference of the substrate 10 when the substrate 10 is loaded into the carrier head. Each segment 153 of the retaining ring 152 has an inner surface 154 configured to engage and retain the substrate 10 (discussed below).

Each segment 153 of the retaining ring 152 is independently pivotally connected to the base assembly 104. For example, in each segment 153, a pair of pivot pins 156 on opposite side walls 159 of the segment 153 can connect the segment to the base assembly 104. The pivot pins 156 could extend from the side walls 159 of the segments 153 into receiving recesses 160 in the base assembly 104, or the pivot pins 156 could extend from the base assembly 104 into receiving recesses in the segment 153. When a segment 153 of the retaining ring 152 rotates about the pivot pins 156, a lower portion 157 of the segment swings toward or away from the substrate 10. In some implementations, segments are pivotally connected to the housing 102 rather than the base assembly 104, e.g., using the techniques described above.

Referring to FIG. 1A, the pivot 156 can hold the segments 153 of the retaining ring 152 in an unclamped, e.g., "open" or "rest" position where the inner surface 154 does not contact the substrate 10. For example, the segments of the retaining ring 152 can be spring-loaded to be held in the unclamped position. While the segments are in the unclamped position, the substrate 10 can be loaded and mounted to the membrane 110 with the substrate positioned between the segments of the retaining ring 152.

Referring to FIG. 1B, once the substrate 10 is mounted to the membrane 110, the segments 153 of the retaining ring 152 can rotate about the pivot 156 to a clamped, e.g., "closed" position. In the clamped position, the inner surface 154 of each segment of the retaining ring 152 contact the substrate 10. This restricts lateral movement of the substrate 10 on the polishing pad 30 within the carrier head 100 during a polishing operation.

An advantage to restricting lateral movement of the substrate 10 within the carrier head 100 is the reduced edge-effect on the substrate 10, as well as the lengthened life-span of the retaining ring 152 due to the decreased wear and tear from the decreased collisions between the retaining ring 152 and the substrate 10. Additionally, the retaining ring 152 is removable and replaceable—as each segment of the retaining ring 152 wears down, each segment of the retaining ring 152 can be removed and replaced as needed.

An actuator 158 can engage the segments 153 of the retaining ring 152 to clamp the segments of the retaining ring 152 to the substrate 10. The actuator 158 can engage the segments of the retaining ring 152 to rotate about the pivot 156 and clamp the substrate 10. For example, the actuator 158 can engage and push on an outer surface 155 of the segments of the retaining ring 152, causing the inner surface 154 to contact the perimeter of the substrate 10 (arrow A). The actuator 158 can be a motor (e.g., electric motor or piezoelectric actuator), piston, hydraulic arm, spring, bellow or bladder. Motion of the actuator 158 can be controlled by a controller 90.

Once the substrate 10 is mounted to the membrane 110 and clamped by the retaining ring 152, the substrate 10 can be polished against the polishing pad 30. As the retaining ring 152 restricts movement of the substrate 10 within the carrier head 100, the substrate incurs less damage at its edges and the retaining ring 152 incurs less damage at its inner walls, because collisions between the substrate 10 and the retaining ring 152 are reduced. Once the polishing operation is completed, the actuator 158 can disengage from or reduce inward pressure on the segments of the retaining ring 152, and the segments of the retaining ring 152 can return to the "open" position. Then, the substrate 10 can be dismounted and another substrate 10 can be mounted to the membrane 110 and clamped by the retaining ring 152 for polishing.

Figure 2A:
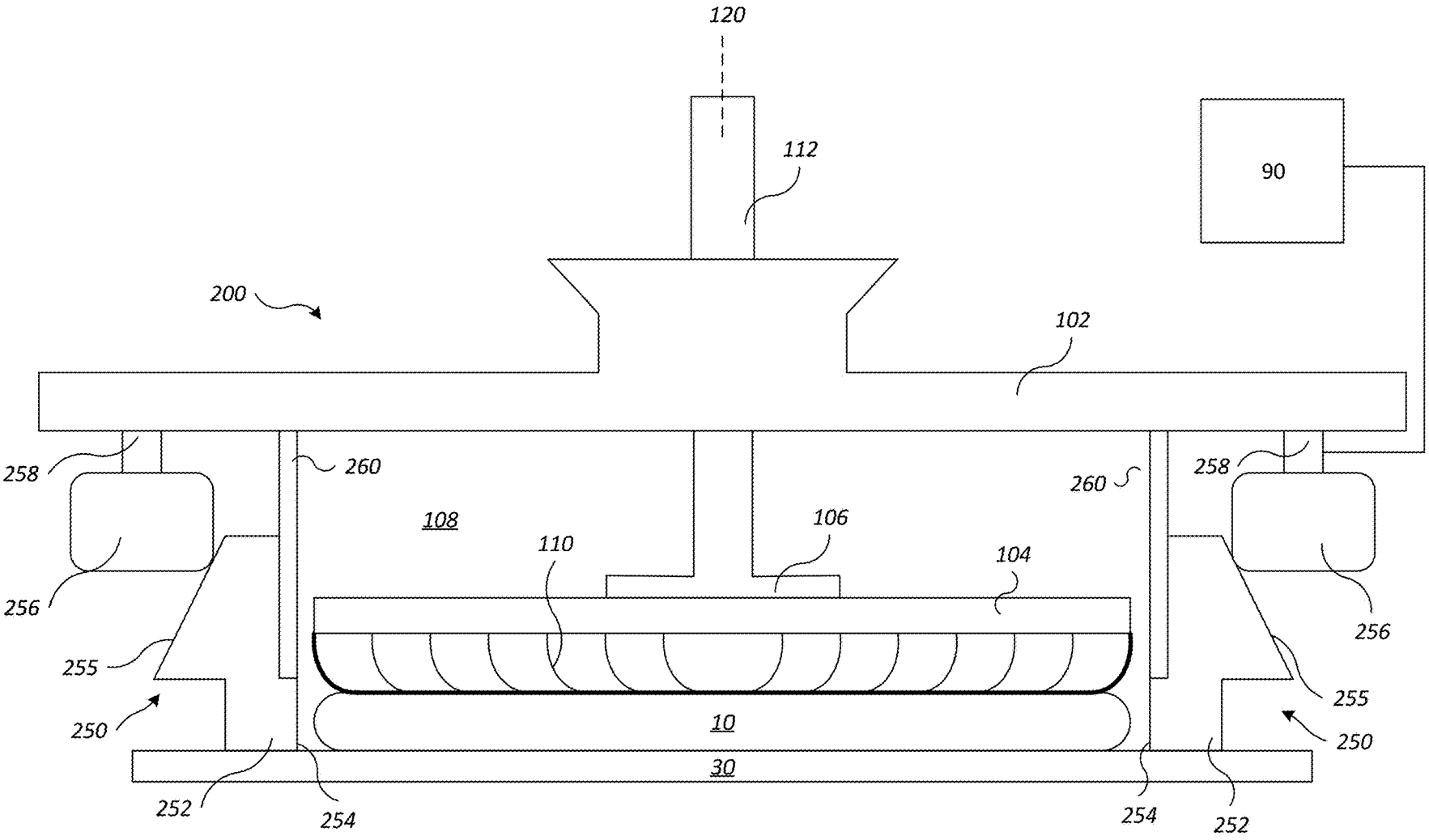
FIG. 2A is a schematic side view of a carrier head with a collet retaining ring and outer ring.
Figure 2B:
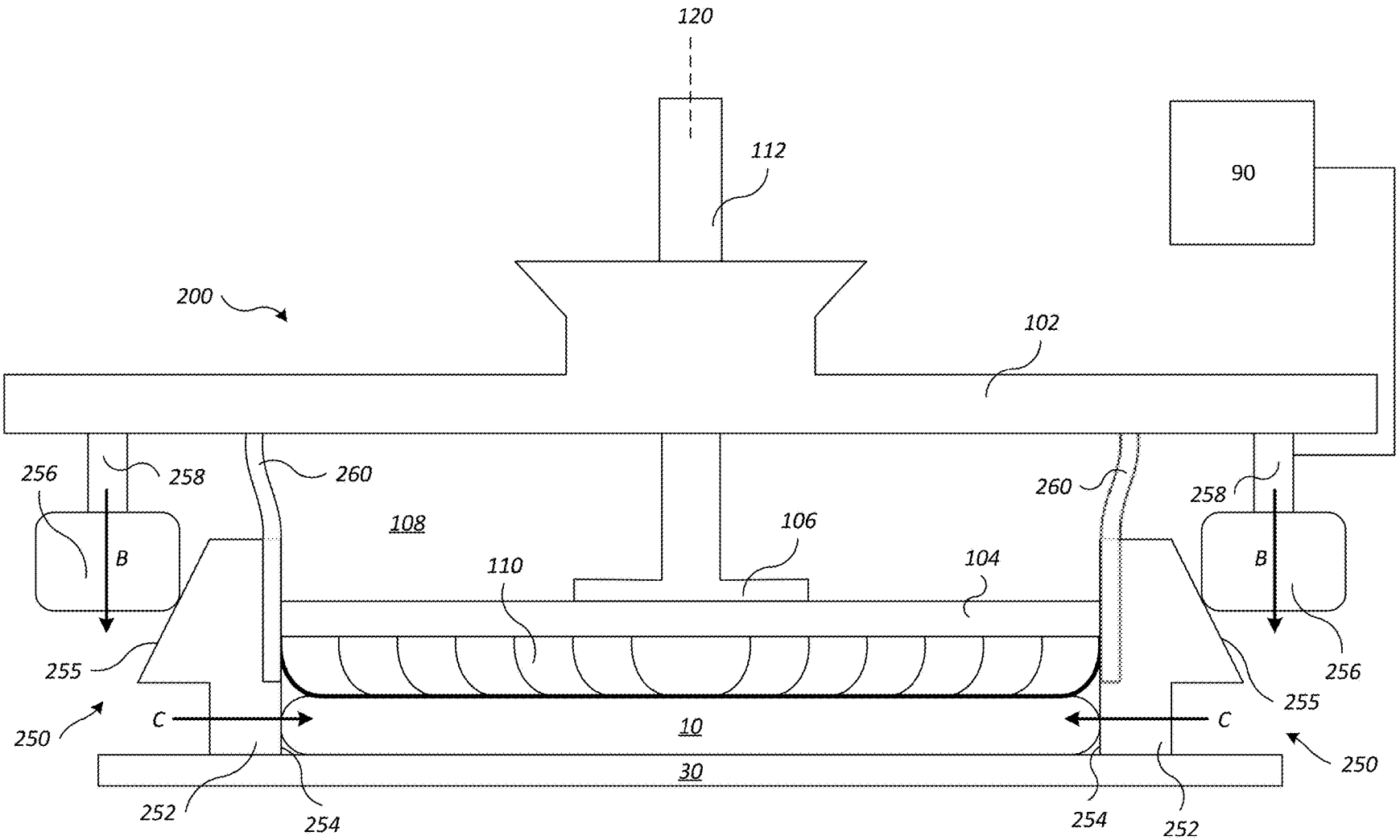
FIG. 2B is a schematic side view of the carrier head of FIG. 2A with the collet retaining ring and outer ring shifted to contact the edge of a substrate.
Figure 2C:
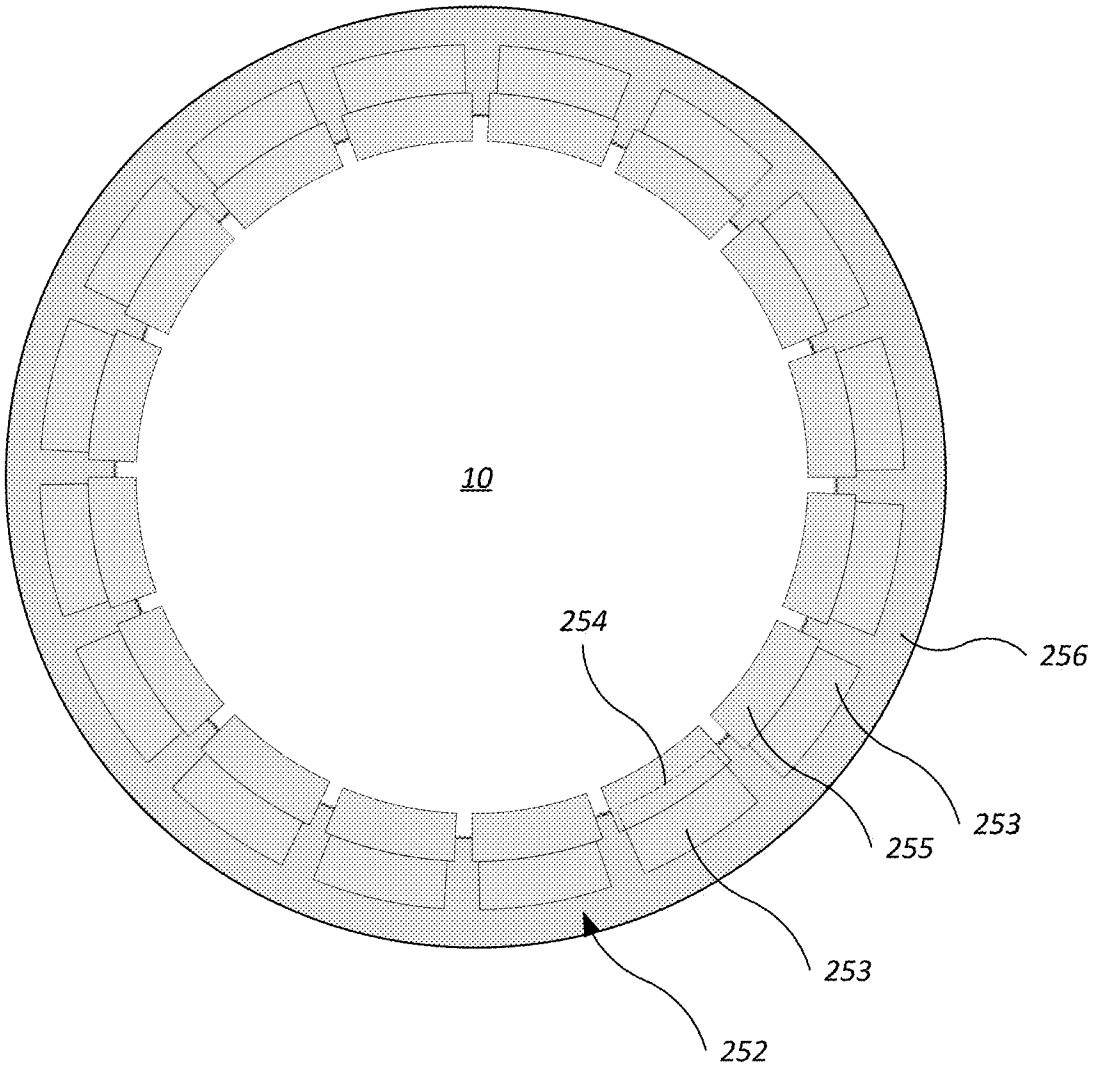
FIG. 2C is a schematic top view of a collet retaining ring and outer ring.

Alternatively, a retaining ring can clamp the substrate 10 to the carrier head using a collet approach. Referring to FIG. 2A-2C, a carrier head 200 includes a retaining ring assembly 250 that can surround the substrate 10. Other than the as described below, the carrier head 200 can be similar to the carrier head 100 described above.

The retaining ring assembly 250 includes a plurality of segments 153, e.g., arcuate segments, that together provide a collet retaining ring 252. There can be two to twenty segments, e.g., fourteen segments, comprising the collet retaining ring 252. Each segment 253 of the collet retaining ring 252 has an inner surface 254 configured to engage and retain the substrate 10 (discussed below).

Each segment 253 of the collet retaining ring 252 is independently laterally movably connected to the base assembly 102. For example, each segment 253 of the collet retaining ring 252 can have a sloped outer surface 255 configured to engage a vertically movable outer ring 256. The segments 253 of the collet retaining ring 252 can be connected to the housing 102 using a flexure 260. The flexure 260 can be a semi-flexible structure that can deform and flex between its connection points at the housing 102 and the segments of the collet retaining ring 252. The flexure 260 permits limited lateral movement of the segments of the collet retaining ring 252 toward or away from the substrate 10, while preventing vertical movement of the segments of the collet retaining ring 252. The flexure 260 can be biased to an unclamped position. In some implementations, the segments of the collet retaining ring 252 are connected by the flexure 260 to the base assembly 104, e.g., using the techniques described above, rather than the housing.

The vertical position of the outer ring 256 can be controlled by an actuator 258. The actuator 258 can be connected to the housing 102. The actuator 258 can be a motor (e.g., electric motor or piezoelectric actuator), piston, hydraulic arm, spring, bellow or bladder that can move the outer ring 256 vertically (arrow B). Vertical movement of ring 256 by the actuator 258 can be controlled using the controller 90.

Referring to FIG. 2A, the flexure 260 can hold the segments of the collet retaining ring 252 in an unclamped, e.g., "open" position where the inner surface 254 does not contact the substrate 10. Without an external force (e.g., force applied to the outer sloped surface 255 by the outer ring 256 as discussed below) engaging the segments 253 of the collet retaining ring 252, the flexure 260 can hold the segments of the collet retaining ring 252 away from the substrate 10, as the flexure 260 can tend to resist deforming and flexing. While the segments 253 are in the unclamped position, the substrate 10 can be loaded and mounted to the membrane 110.

Referring to FIG. 2B, once the substrate 10 is mounted to the membrane 110, the actuator 260 can move the outer ring 256 vertically down to contact the sloped outer surface 255 of the segments of the collet retaining ring 252 (arrow B). As the outer ring 256 engages the sloped outer surface 255 of the collet retaining ring 252, the segments of the collet retaining ring 252 are pushed laterally inwardly toward the substrate 10 (arrow C). Further, as the outer ring 256 engages the collet retaining ring 252, the flexure 260 deforms and flexes. Lateral movement of the collet retaining ring 252 can cause the collet retaining ring 252 to tightly enclose the substrate 10, restricting vertical movement of the collet retaining ring 252 relative to the carrier head 200 during a polishing operation. As such, the inner surface 254 contacts and retains the substrate 10, restricting lateral movement of the substrate 10 within the carrier head 200 during a polishing operation.

An advantage to restricting lateral movement of the substrate 10 within the carrier head 200 is reduced the edge-effect on the substrate 10, as well as lengthened life-span of the collet retaining ring 252 due to the decreased wear and tear from decreased collisions between the collet retaining ring 252 and the substrate 10. Additionally, the collet retaining ring 252 is removable and replaceable.

Once the substrate 10 is mounted to the membrane 110 and clamped by the collet retaining ring 252, the substrate 10 can be polished against the polishing pad 30. As the collet retaining ring 252 restricts movement of the substrate 10 within the carrier head 100, the substrate incurs less damage at its edges and the collet retaining ring 252 incurs less damage at its inner walls, because collisions between the substrate 10 and the collet retaining ring 252 are reduced. Once the polishing operation is completed, the outer ring 256 can move upwardly to disengage from the segments of the collet retaining ring 252, and the segments of the collet retaining ring 252 can return to the "open" position. Then, the substrate 10 can be dismounted and another substrate 10 can be mounted to the membrane 110 and clamped by the collet retaining ring 252 for polishing.

A number of embodiments of the invention have been described. Nevertheless, it will be understood that various modifications may be made without departing from the spirit and scope of the invention. Accordingly, other implementations are within the scope of the following claims.

What is claimed is:

1. A carrier head, comprising:

a base assembly;

a substrate mounting surface connected to the base assembly; and a plurality of segments disposed circumferentially around the substrate mounting surface to provide a retaining ring to surround a substrate mounted on the substrate mounting surface, wherein an inner surface of each of the plurality of segments is configured to engage the substrate, and wherein each segment of the plurality of segments of the retaining ring is independently pivotally connected to the base assembly such that a lower portion of each segment of the retaining ring is swingable toward and away from the substrate, wherein each segment of the plurality of segments of the retaining ring is pivotally connected by a pivot pin that extends collinearly with an axis of rotation of the segment.

2. The carrier head of claim 1, wherein the retaining ring includes four to twenty segments.

3. The carrier head of claim 1, comprising an actuator to cause the segments of the retaining ring to pivot.

4. The carrier head of claim 3, wherein the actuator is a motor, piston, hydraulic arm, spring, bellow or bladder.

5. The carrier head of claim 1, wherein pivot pins extend from side walls of the segment into receiving recesses in the base assembly.

6. The carrier head of claim 1, wherein pivot pins extend from receiving recesses in the base assembly into side walls of the segment.

7. A carrier head, comprising:

a base assembly;

a substrate mounting surface connected to the base assembly;

a plurality of segments disposed circumferentially around the substrate mounting surface to provide a retaining ring to surround a substrate mounted on the substrate mounting surface, wherein an inner surface of each of the plurality of segments is configured to engage the substrate, and wherein each segment of the plurality of segments of the retaining ring is independently pivotally connected to the base assembly such that a lower portion of each segment of the retaining ring is swingable toward and away from the substrate; and an actuator to cause the segments of the retaining ring to pivot, wherein the actuator is configured to engage outer surfaces of the segments of retaining ring.

8. The carrier head of claim 7, wherein the actuator is configured to apply a lateral force on the outer surfaces of the segments of the retaining.

9. The carrier head of claim 1, wherein the segments of the retaining ring are spring-loaded to be held in an unclamped position.

* * * * *